US010240860B2

(12) United States Patent
Han et al.

(10) Patent No.: US 10,240,860 B2
(45) Date of Patent: Mar. 26, 2019

(54) REFRIGERATOR

(71) Applicant: LG ELECTRONICS INC., Seoul (KR)

(72) Inventors: Junsoo Han, Seoul (KR); Younseok Lee, Seoul (KR); Ahreum Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 307 days.

(21) Appl. No.: 15/065,647

(22) Filed: Mar. 9, 2016

(65) Prior Publication Data

US 2016/0282037 A1 Sep. 29, 2016

(30) Foreign Application Priority Data

Mar. 25, 2015 (KR) ..... 10-2015-0041313

(51) Int. Cl.

| | |
|---|---|
| ***F25D 17/08*** | (2006.01) |
| ***F25D 25/02*** | (2006.01) |
| ***F25D 17/06*** | (2006.01) |
| ***F25D 23/06*** | (2006.01) |
| ***F25D 23/00*** | (2006.01) |

(52) U.S. Cl.

CPC ..... *F25D 25/028* (2013.01); *F25D 17/065* (2013.01); *F25D 23/00* (2013.01); *F25D 23/069* (2013.01); *F25D 25/025* (2013.01); *F25D 2317/061* (2013.01); *F25D 2400/16* (2013.01)

(58) Field of Classification Search

CPC .. F25D 11/02; F25D 19/003; F25D 2317/061; F25D 2317/067; F25D 2317/062; F25D 2317/0666; F25D 19/00; F25D 25/028; F25D 23/00; F25D 17/065; F25D 23/069; F25D 25/025; F25D 2400/16;

(Continued)

(56) References Cited

U.S. PATENT DOCUMENTS

| | | | |
|---|---|---|---|
| 5,154,502 | A | 10/1992 | Takaoka |
| 5,312,180 | A | 5/1994 | Tieder et al. |

(Continued)

FOREIGN PATENT DOCUMENTS

| | | |
|---|---|---|
| CN | 101929785 | 12/2010 |
| CN | 203837393 | 9/2014 |

(Continued)

OTHER PUBLICATIONS

European Office Action dated May 29, 2017 issued in Application No. 16160375.8.

(Continued)

*Primary Examiner* — David Teitelbaum
*Assistant Examiner* — Kamran Tavakoldavani
(74) *Attorney, Agent, or Firm* — KED & Associates, LLP

(57) ABSTRACT

A refrigerator may include a cabinet configured to form a storage compartment; and a drawer provided inside the storage compartment to be withdrawn, wherein the drawer includes a drawer body which forms a storage space; and a divider which is movably installed at the drawer body, and divides the storage space into a first space to which cooling air is supplied and a second space which is indirectly cooled by the cooling air, and the first space and the second space are controlled at different temperatures from each other.

16 Claims, 11 Drawing Sheets

(58) Field of Classification Search
CPC .... F25C 1/00; F25C 1/24; F25C 5/185; F25C 5/182; F25C 5/005
See application file for complete search history.

(56) References Cited

U.S. PATENT DOCUMENTS

| | | | | |
|---|---|---|---|---|
| 7,665,327 | B2 * | 2/2010 | Tunzi | F25D 17/065 62/408 |
| 9,766,010 | B2 * | 9/2017 | Katu | F25D 27/00 |
| 2006/0086129 | A1 * | 4/2006 | Anselmino | F25C 5/22 62/344 |
| 2010/0319391 | A1 | 12/2010 | Lim et al. | |
| 2012/0091872 | A1 * | 4/2012 | Matthes | A47B 88/40 312/334.8 |
| 2014/0265802 | A1 | 9/2014 | Wilcox et al. | |
| 2015/0059399 | A1 | 3/2015 | Hwang et al. | |

FOREIGN PATENT DOCUMENTS

| | | | |
|---|---|---|---|
| EP | 2 752 632 | | 7/2014 |
| EP | 3106808 | | 12/2016 |
| KR | 10-0570531 | B1 | 4/2006 |
| KR | 10-2011-0109348 | A | 10/2011 |
| KR | 10-2013-0044959 | A | 5/2013 |

OTHER PUBLICATIONS

European Search Report dated Jul. 27, 2016 issued in Application No. 16 16 0375.8.
Korean Office Action issued in Application No. 10-2015-0041313 dated Jan. 21, 2016.
Chinese Office Action dated Jan. 2, 2018 issued in Application Serial No. 201610176741.4.

* cited by examiner

REFRIGERATOR

CROSS-REFERENCE TO RELATED APPLICATION(S)

This application claims priority under 35 U.S.C. § 119 and 35 U.S.C. § 365 to Korean Patent Application No. 10-2015-0041313, filed in Korea on Mar. 25, 2015, whose entire disclosure is hereby incorporated by reference.

BACKGROUND

1. Field

A refrigerator is disclosed herein.

2. Background

Generally, a refrigerator may have a plurality of storage compartments which keep accommodated food frozen or refrigerated, and one surface of each of the storage compartments may be formed to be opened to put in or take out the food. The plurality of storage compartments may include a freezer compartment to store the food frozen and a refrigerator compartment to store the food refrigerated.

A refrigeration system in which a refrigerant is circulated may be driven in the refrigerator. The refrigeration system may include a compressor, a condenser, an expander, and an evaporator. For example, the evaporator may include a first evaporator provided at one side of the refrigerator compartment, and a second evaporator provided at one side of the freezer compartment.

Cooling air stored in the refrigerator compartment may be cooled while passing through the first evaporator, and the cooling air may be supplied again into the refrigerator compartment. The cooling air stored in the freezer compartment may be cooled while passing through the second evaporator, and the cooling air may be supplied again into the freezer compartment.

A drawer which forms a storage space for accommodating the food may be provided at the refrigerator. The drawer may be withdrawn from a main body of the refrigerator. A device which divides the storage space of the drawer may be provided at the drawer.

A refrigerator drawer is disclosed in Korean Patent Application No 10-2011-0109348, filed Oct. 25, 2011, whose entire disclosure is hereby incorporated by reference. In the refrigerator drawer, a partition divides a storage space of the drawer, and a partitioning size of the storage space may be changed according to a size of the food. The related art has described only the spirit in which sizes of a plurality of spaces having the same temperature condition are changed, and there is a limitation in independently controlling the temperature of each of the divided storage spaces.

BRIEF DESCRIPTION OF THE DRAWINGS

The embodiments will be described in detail with reference to the following drawings in which like reference numerals refer to like elements wherein.

DETAILED DESCRIPTION

Figure 1:
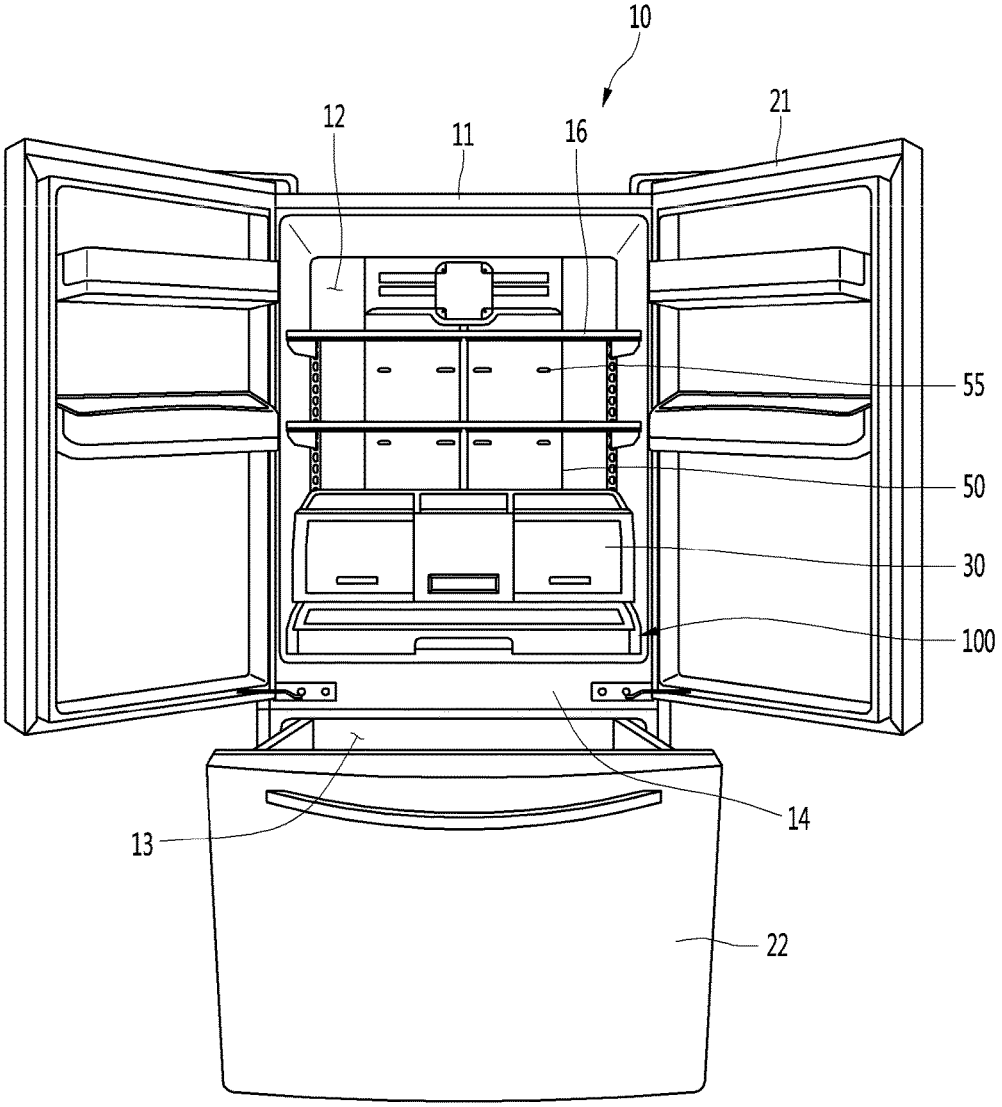
FIG. 1 illustrates a configuration of a refrigerator according to an embodiment.
Figure 2:
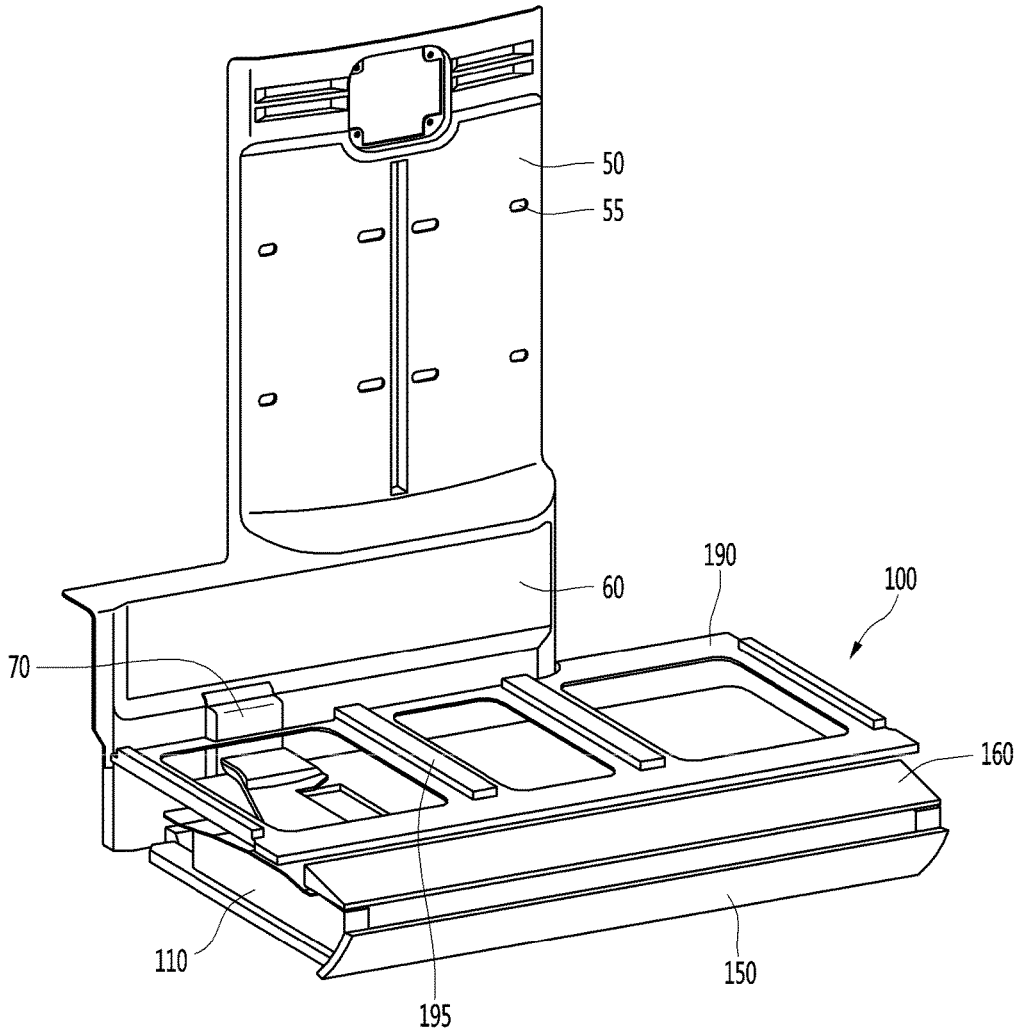
FIG. 2 illustrates a partial configuration of the refrigerator according to the embodiment.
Figure 3:
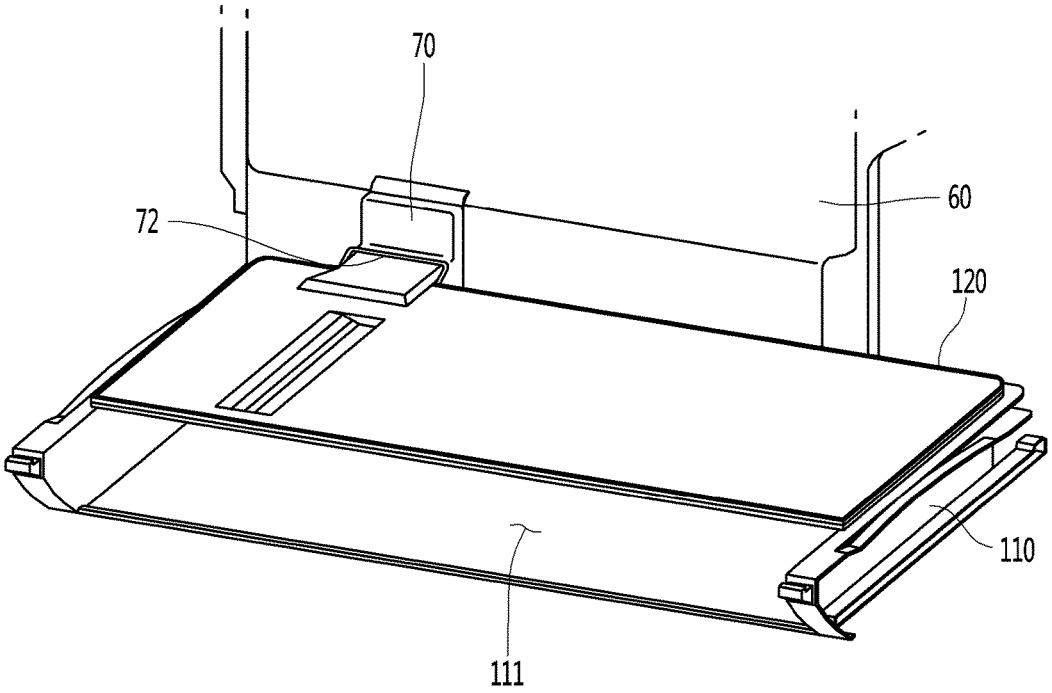
FIG. 3 illustrates a partial configuration of a drawer according to the embodiment.

Referring to FIGS. 1 to 3, a refrigerator 10 may include a cabinet 11 which may form storage spaces 12 and 13, and doors 21 and 22 which may close an open front surface of the cabinet 11. The storage spaces 12 and 13 may include a refrigerator compartment 12 which keeps food refrigerated, and a freezer compartment 13 which keeps food frozen. The refrigerator compartment 12 may be formed at an upper side of the freezer compartment 13. The refrigerator 10 may further include a partition part (or partition) 14 which divides the refrigerator compartment 12 and the freezer compartment 13. The partition part 14 may be provided between the refrigerator compartment 12 and the freezer compartment 13.

The doors 21 and 22 may include a refrigerator door 21 which opens and closes the refrigerator compartment 12, and a freezer door 22 which opens and closes the freezer compartment 13. The refrigerator door 21 may be rotatably coupled to a front of the cabinet 11, and two refrigerator doors 21 may be provided at both sides of the cabinet. The freezer door 22 may be provided to be withdrawn forward. A basket which stores the food may be coupled to a rear side of the freezer door 22. The basket may be withdrawn forward together with the freezer door 22 or may be inserted into the freezer compartment 13.

The refrigerator 10 may further include a multi-duct 50 that forms a rear wall of the refrigerator compartment 12 and has a cooling air outlet hole 55 through which cooling air generated at an evaporator may be discharged to the refrigerator compartment 12. A plurality of cooling air outlet holes 55 may be formed and may be arranged vertically or horizontally. The cooling air discharged to the refrigerator compartment 12 through the plurality of cooling air outlet holes 55 may cool the refrigerator compartment 12 while being circulated in the refrigerator compartment 12.

The refrigerator 10 may further include a vegetable box 30 which stores vegetables. The vegetable box 30 may be provided to be withdrawn forward, and a plurality of vegetable boxes 30 may be horizontally provided. For example, as illustrated in FIG. 1, three vegetable boxes 30 may be installed. A drawer 100 having a plurality of storage spaces having different temperatures from each other may be installed under the vegetable boxes 30. The drawer 100 may be provided to be withdrawn forward. The drawer 100 may be installed between the vegetable boxes 30 and the partition part 14, and a lower surface of the drawer 100 may be located on an upper surface of the partition part 14, and a guide device which guides movement of the vegetable boxes 30 may be installed on an upper surface of the drawer 100.

The refrigerator 10 may include a rear panel 60 which may extend to a lower side of the multi-duct 50 and form a part of the rear wall of the refrigerator compartment 12. The rear panel 60 may be integrally formed with the multi-duct 50, or may be formed as a separate panel member coupled to the multi-duct 50. The evaporator acting as a heat exchanger which generates the cooling air may be installed at a rear side of the multi-duct 50 and the rear panel 60. At least a portion of the cooling air generated at the evaporator may be introduced into the refrigerator compartment 12 through the cooling air outlet hole 55, and another portion of the cooling air may be introduced into the storage space of the drawer 100.

A fan housing 70 which accommodates a fan 80 (referring to FIG. 4) may be provided at one side of the rear panel 60. An outlet port 72 through which the cooling air passed through the fan 80 may be discharged may be formed at the fan housing 70. The outlet port 72 may be in communication with the drawer 100, and the cooling air discharged from the outlet port 72 may be supplied into the storage space 111 of the drawer 100.

The drawer 100 may be coupled to a front of the fan housing 70. Specifically, the drawer 100 may include a drawer body 110 which may form the storage space 111 and have an open upper portion, a cooling air duct 120 which may shield at least a part of the open upper portion of the drawer body 110 and form a path through which the cooling air passed through the fan 80 flows, and an upper side cover 190 which may be provided at an upper side of the cooling air duct 120.

The upper side cover 190 may include a guide device which may guide withdrawing of the vegetable box 30. The guide device may include a guide rail 195 which may horizontally extend on an upper surface of the upper side cover 190. The number of guide rails 195 may correspond to the number of vegetable boxes 30, and each of the vegetable boxes 30 may be withdrawn forward along the guide rail 195.

The drawer 100 may further include an upper surface cover 160 which may shield a front upper portion of the open upper portion of the drawer body 110, and a front surface cover 150 which may shield a front surface of the open upper portion. Both of the upper surface cover 160 and the front surface cover 150 may be collectively referred to as a 'cover member'. An air layer may be formed at the cooling air duct 120, the upper surface cover 160 and the front surface cover 150, and an insulation effect may be improved by the air layer.

Figure 4:
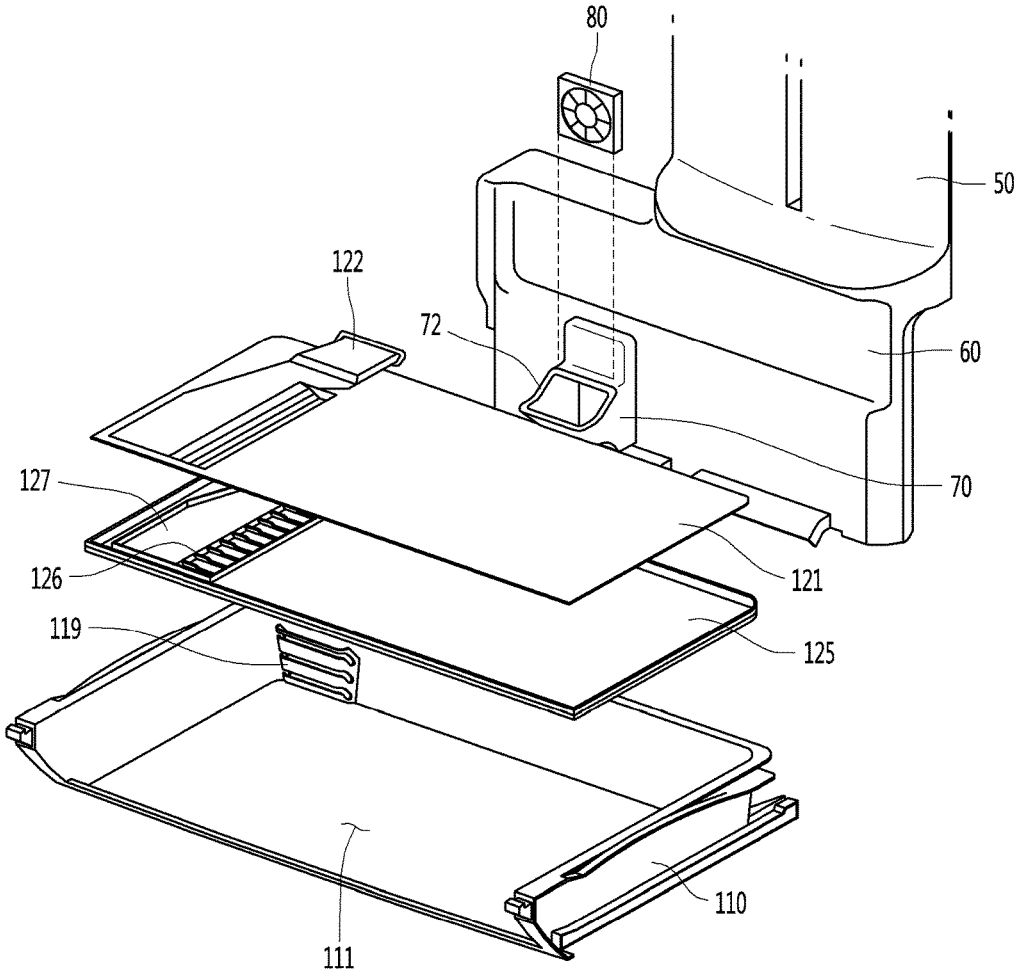
FIG. 4 is an exploded perspective view illustrating a configuration of the drawer according to the embodiment.
Figure 5:
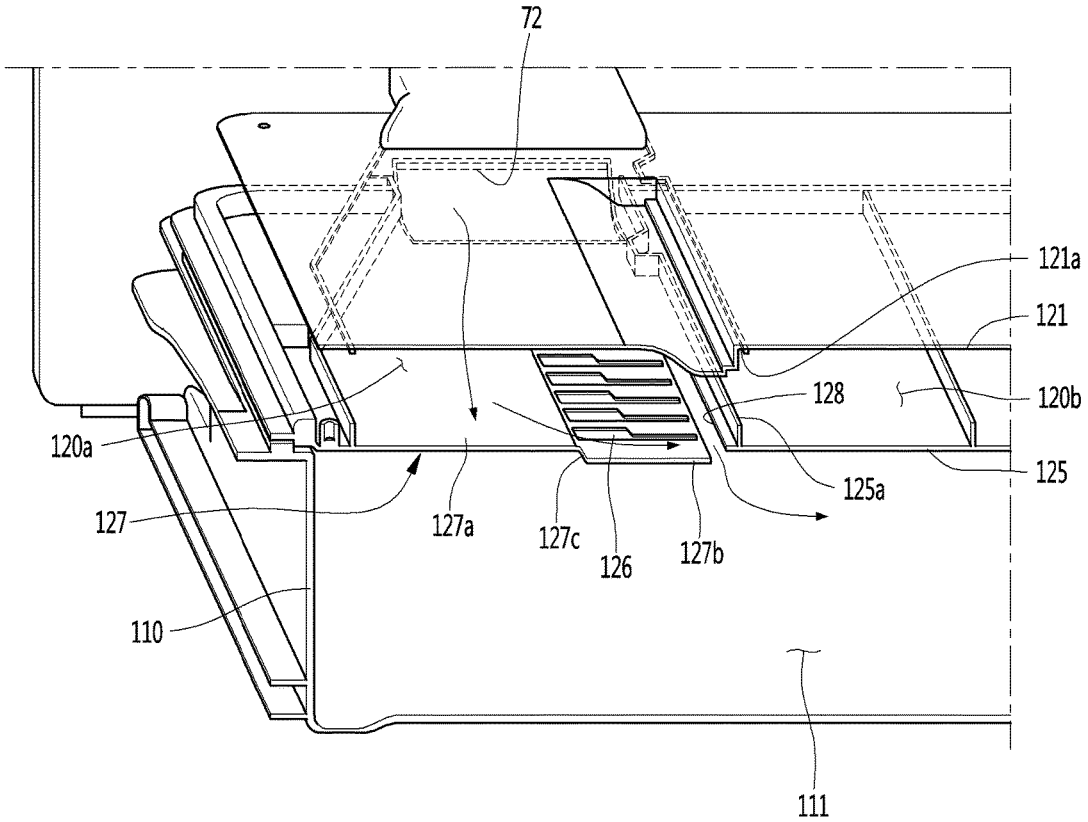
FIG. 5 is an exploded perspective view illustrating a configuration of a cooling air path of the drawer according to the embodiment.
Figure 6:
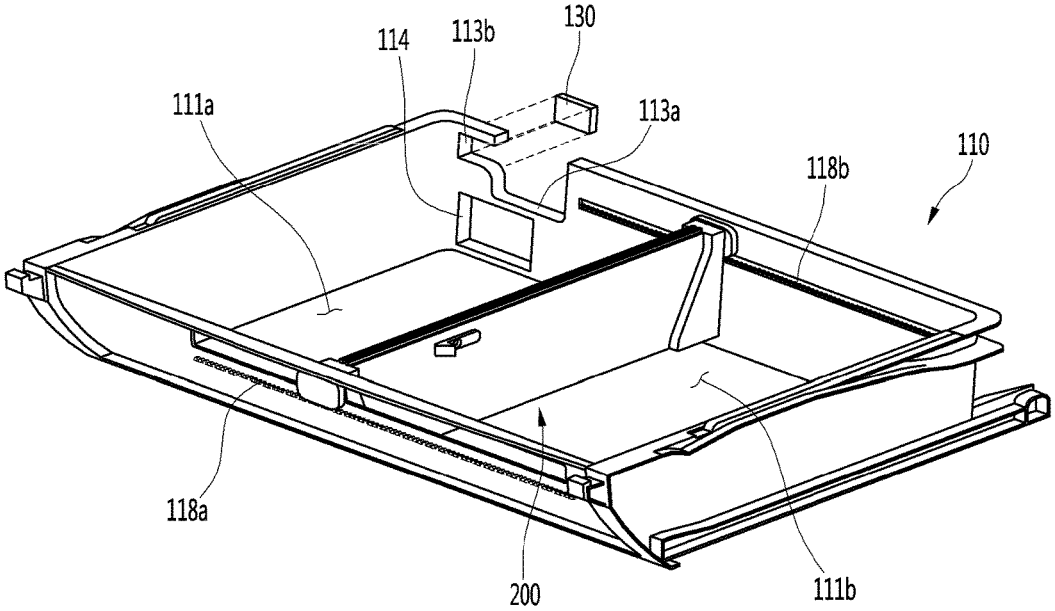
FIG. 6 illustrates a configuration of a drawer body according to the embodiment.
Figure 7:
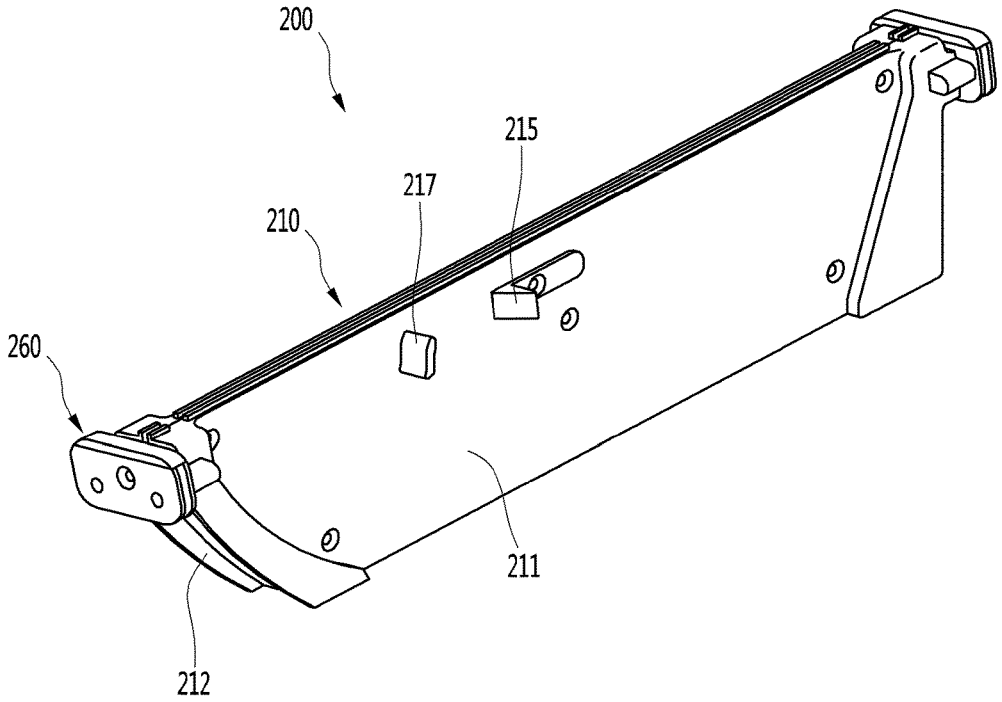
FIG. 7 illustrates a configuration of a divider according to the embodiment.
Figure 8:
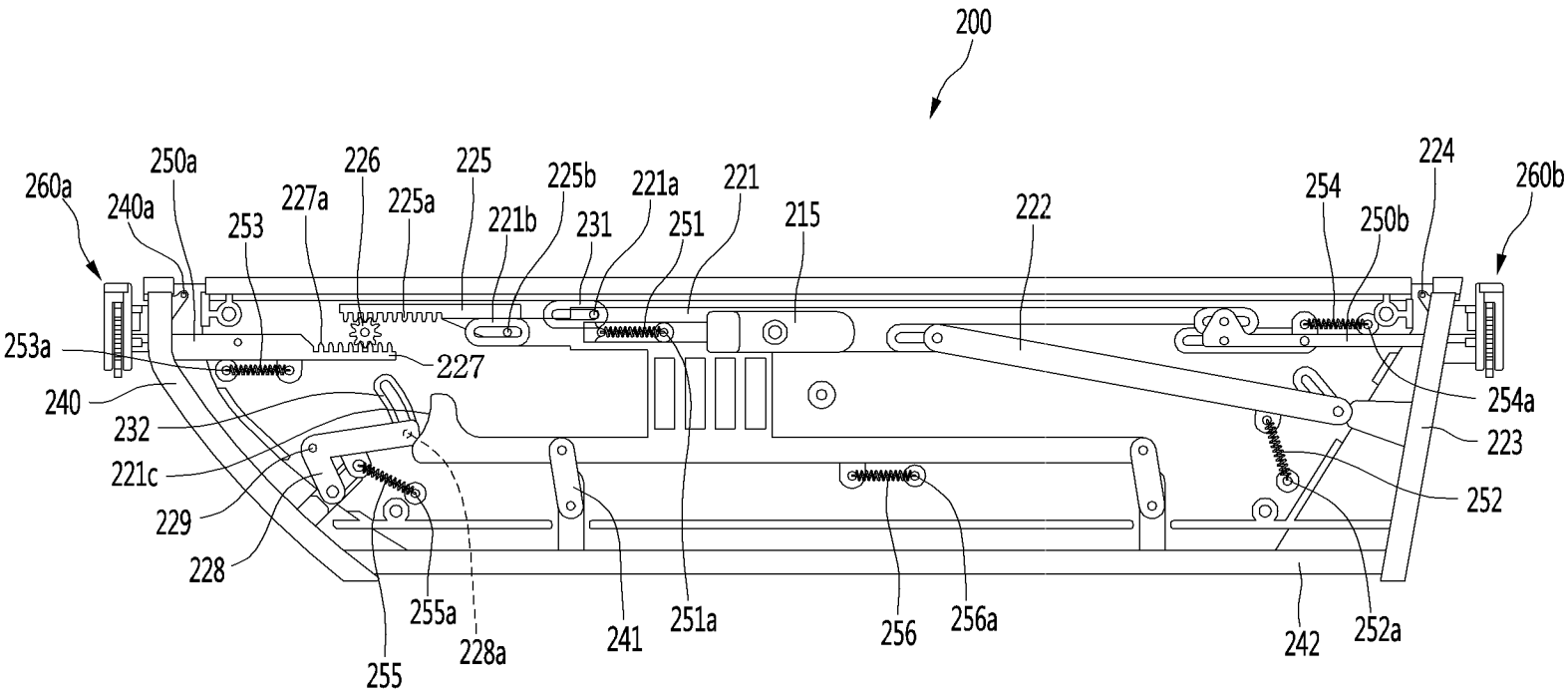
FIG. 8 illustrates an internal configuration of the divider according to the embodiment.

Referring to FIGS. 4 to 6, the fan housing 70 according to the embodiment may be formed to protrude forward from the rear panel 60. The outlet port 72 through which the cooling air passed through the fan 80 may be discharged may be formed at an upper portion of the fan housing 70. The fan 80 may be installed at a space inside the fan housing 70.

The cooling air duct 120 may include a first cover 121, and a second cover 125 coupled to a lower side of the first cover 121. A cooling air path 120*a* through which the cooling air discharged from the outlet port 72 flows and an air layer (or air circulation path) 120*b* which may be formed by air injected for the insulation effect may be provided between the first cover 121 and the second cover 125.

The cooling air path 120*a* and the air layer 120*b* may be divided by coupling parts 121*a* and 125*a*. The coupling parts 121*a* and 125*a* may include a first coupling part (or female coupler) 121*a* which may protrude to a lower side of the first cover 121, and a second coupling part (or male coupler) 125*a* which may protrude to an upper side of the second cover 125. The first coupling part 121*a* and the second coupling part 125*a* may be arranged to be coupled to or in contact with each other when the first and second covers 121 and 125 are assembled, and thus may separate the cooling air path 120*a* and the air layer 120*b* from each other.

The first cover 121 may include a cover 122 which may cover the outlet port 72 of the fan housing 70. The cover 122 may correspond to a shape of the outlet port 72, and may guide the cooling air discharged from the outlet port 72 to the cooling air path 120*a* between the first and second covers 121 and 125.

The second cover 125 may include a guide surface 127 which may guide a flow of the cooling air discharged from the outlet port 72, and a plurality of ribs 126 provided at one side of the guide surface 127. The guide surface 127 may form a flat upper surface of the second cover 125, and the ribs 126 may be provided to protrude upward from the upper surface of the second cover 125. The plurality of ribs 126 may be provided at a front of the outlet port 72, and the guide surface 127 may be provided at a side of the plurality of ribs 126. The plurality of ribs 126 may serve as a 'blocking part' which may relatively block the flow of the cooling air discharged from the outlet port 72. Therefore, the cooling air may bypass the plurality of ribs 126, and may flow through a side of the guide surface 127.

If the cooling air discharged from the outlet port 72 flows straight forward and then is immediately introduced into the drawer body 110, there may be a problem that the cooling air is not circulated in the storage space 111 of the drawer body 110, and is immediately discharged through an inlet port 114 of the drawer body 110. Therefore, in the embodiment, by providing the plurality of ribs 126, the cooling air does not flow straight forward, but may be introduced in a predetermined arc into the drawer body 110.

A suction guide 119 which may guide the flow of the cooling air flowing to the inlet port 114 may be installed at a front of the inlet port 114. The cooling air in a first space part 111*a* may be suctioned into the inlet port 114 via the suction guide 119, and then may flow to the evaporator. The second cover 125 may include a communication part (or communication hole) 128 through which the cooling air flowing through the cooling air path 120*a* may be guided inside the drawer body 110. The communication part 128 may be formed by cutting at least a part of the second cover 125. Alternatively, the communication part 128 may be formed between the guide surface 127 forming the cooling air path 120*a* and a part of the second cover 125 forming the air layer 120*b*.

The guide surface 127 of the second cover 125 may include a flat portion (or flat surface) 127*a*, a rib installation portion 127*b* at which the ribs 126 may be installed, and a stepped portion (or step) 127*c* which may be formed to be stepped downward from the flat portion 127*a* toward the rib installation portion 127*b*. Based on the stepped portion 127*c*, the rib installation portion 127*b* may be provided at a position lower than the flat portion 127*a*. The communication part 128 may also be formed at one end of the rib installation portion 127*b*, and located close to one side of the coupling parts 121*a* and 125*a*.

A flowing direction of the cooling air discharged from the fan housing 70 and flowing along the flat portion 127*a* may be switched while the cooling air passes the stepped portion 127*c*, and thus the cooling air may flow downward, and may be introduced into the storage space 111 of the drawer body 110 via the communication part 128. According to such a configuration, the flow direction of the cooling air discharged from the outlet port 72 may be switched while the cooling air passes through the guide surface 127, the stepped portion 127*c* and the communication part 128, and thus the cooling air may be introduced into the storage space 111 of the drawer body 110. The flow from a lateral side of the drawer body 110 toward a center of the drawer body 110 may be formed, and thus the cooling air may be effectively circulated in the storage space 111.

Seating parts (or seats) 113*a* and 113*b* which may be recessed in a predetermined direction may be formed at a rear surface of the drawer body 110. Specifically, the seating parts 113*a* and 113*b* may include a first seating part 113*a* which may support at least a part of the fan housing 70, and a second seating part 113*b* on which a temperature sensor 130 may be seated. For example, the first seating part 113*a* may be formed to be recessed downward from an upper portion of the rear surface of the drawer body 110, and the second seating part 113*b* may be formed to be further recessed laterally from the first seating part 113*a*. The inlet port 114 through which the cooling air in the storage space 111 may be discharged may be formed at the rear surface of the drawer body 110. The inlet port 114 may be formed at a lower side of the fan housing 70 or a lower side of the seating parts 113*a* and 113*b*.

A divider 200 which may divide the storage space 111 may be installed at the drawer body 110. For example, the divider 200 may divide the storage space 111 into left and right spaces. The storage space 111 may include the first space part (or first storage space) 111*a* which may be formed at one side of the divider 200, and a second space part (or second storage space) 111*b* which may be formed at the other side of the divider 200. The first space part 111*a* and the second space part 111*b* may be independent spaces which are respectively controlled at different temperatures from each other. Specifically, the first space part 111*a* may be a space to which the cooling air flowed through the cooling air path 120*a* may be supplied, i.e., a space which is in communication with the outlet port 72, and the second space part 111*b* may be a space to which separate cooling air may not be supplied, and which may be indirectly cooled by a temperature of the first space part 111*a* or a temperature of the refrigerator compartment 12 therearound.

The divider 200 may have a plate shape having upper and lower surfaces and front and rear surfaces. The divider 200 may be provided so that the lower surface of the divider 200 is in contact with a lower surface of the drawer body 110, the upper surface of the divider 200 is in contact with the cooling air duct 120 or the upper surface cover 160, the front surface of the divider 200 is in contact with the front surface cover 150, and the rear surface of the divider 200 is in contact with the rear surface of the drawer body 110. The divider 200 may be movably provided inside the drawer body 110.

The drawer 100 may include a guide device which may guide movement of the divider 200. The guide device may include a first rack 118*a* which may be provided at the front surface cover 150, and a second rack 118*b* which may be provided at the rear surface of the drawer body 110. The first and second racks 118*a* and 118*b* may extend left and right, and the divider 200 may be moved along the first and second racks 118*a* and 118*b*.

Referring to FIGS. 7 to 10, the divider 200 may include a divider body 210 which may form an exterior. The divider body 210 may include a first body 211 and a second body 212. For example, the first body 211 may form a first side surface of the divider 200, and the second body 212 may form a second side surface of the divider 200. The first and second bodies 211 and 212 may be coupled left and right. A lever 215 which may be operated by a user may be provided at the first body 211 or the second body 212.

A finger supporting part (or finger support) 217 which may support a user's finger to enable the user to easily operate the lever 215 may be installed at a front of the lever 215. While at least one of the user's fingers may be supported by the finger supporting part 217, the lever 215 may be pulled forward, and thus a force for moving the divider 200 may be provided. For example, the lever 215 and the finger supporting part 217 may be provided at one surface of each of the first and second bodies 211 and 212.

The divider 200 may further include a movement guide device 260 which may be installed at front and rear portions of the divider body 210 and interlocked with the first and second racks 118*a* and 18*b*, respectively. The movement guide device 260 may include a first guide device 260*a* which may be interlocked with the first rack 118*a*, and a second guide device 260*b* which may be interlocked with the second rack 118*b*.

A power transmission device for moving the divider 200 may be provided inside or between the first and second bodies 211 and 212. The power transmission device may include a first link 221 which may be coupled to the lever 215, and a second link 222 which may be coupled to the first link 221 and extend backward. The divider 200 may further include a rear surface supporting part (or rear surface support) 223 which may be coupled to the second link 222. The rear surface supporting part 223 may be one of a plurality of supporting parts 223, 240 and 242 which may be in close contact with or sealed to the rear surface of the drawer body 110, and may be provided to be rotatable. A plurality of rear surface supporting parts 223 may be provided at both sides of a rear of the divider body 210. A first side of the second link 222 may be coupled to the first link 221, and a second side of the second link 222 may be coupled to the rear surface supporting part 223.

The divider 200 may further include a first central shaft 224 which may be provided at one side of the rear surface supporting part 223 to serve as a rotating center of the rear surface supporting part 223. The first central shaft 224 may be provided at an upper portion of the rear surface supporting part 223. The second link 222 may be coupled to an approximately center portion of the rear surface supporting part 223.

When the user pulls forward the lever 215 by a predetermined distance, the first link 221 may be moved forward, and the second link 222 may also be moved forward according to movement of the first link 221. According to movement of the second link 222, a force acting forward may be applied to the approximately center portion of the rear surface supporting part 223, and thus the rear surface supporting part 223 may be rotated about the first central shaft 224. For example, the rear surface supporting part 223 may be rotated clockwise in FIG. 8.

The first link 221 may include a first pin 221*a*. The first pin 221*a* may be inserted into a first pin guide 231 provided at an inner surface of the divider body 210. The first pin 221*a* may be moved at an inside of the first pin guide 231, and may interfere with the first pin guide 231 when being moved by a predetermined distance. The first pin guide 231 may serve as a stopper of the first pin 221*a*.

The power transmission device may further include a first guide rack 225 which may be interlocked with the first link 221. The first guide rack 225 may include a plurality of first gear teeth 225*a*. The first link 221 includes a second pin guide 221*b* into which a second pin 225*b* of the first guide rack 225 may be inserted. When the first link 221 is moved forward while the second pin 225*b* is inserted into the second pin guide 221*b*, the second pin 225*b* may be pressed by the second pin guide 221*b*. Therefore, the second pin 225*b* and the first guide rack 225 may be moved forward.

The power transmission device may further include a guide pinion 226 which may be interlocked with the first guide rack 225, and a second guide rack 227 which may be interlocked with the guide pinion 226. The guide pinion 226 may be provided to be rotated in place. For example, the guide pinion 226 may be installed at the inner surface of the divider body 210. The second guide rack 227 may include a plurality of second gear teeth 227*a*. The guide pinion 226 may be rotatably provided between the first guide rack 225 and the second guide rack 227. For example, the first guide rack 225 may be provided at an upper side of the guide pinion 226, and the second guide rack 227 may be provided at a lower side of the guide pinion 226. While the first guide rack 225 is moved forward, the guide pinion 226 may be rotated counterclockwise (in FIG. 8), and the second guide rack 227 may be moved backward according to rotation of the guide pinion 226.

The power transmission device may further include a first brake bar 250*a* which may be coupled to a front of the second guide rack 227. The first brake bar 250*a* may be located between two pinions 261 and 262 provided at the first guide device 260*a*, and thus may prevent rotation of the two pinions 261 and 262. The two pinions 261 and 262 may include a first pinion 261 and a second pinion 262. The first brake bar 250*a* may include a front portion 250*c* which may be located between the first and second pinions 261 and 262 and may prevent the rotation of the first and second pinions 261 and 262.

Figure 9:
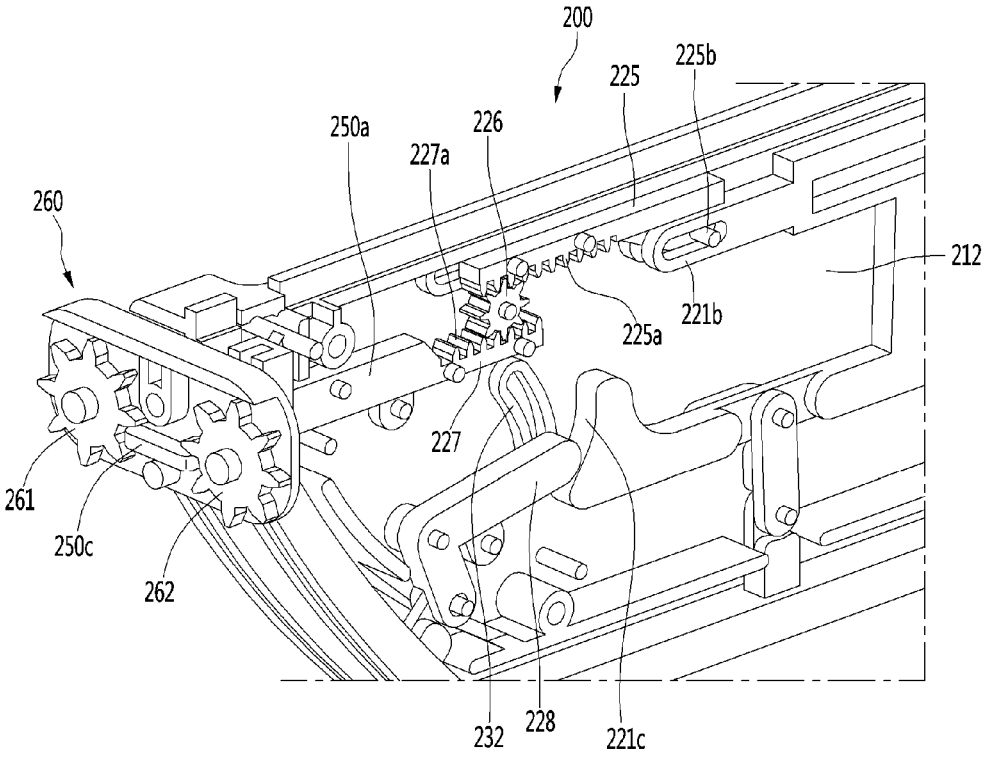
FIG. 9 illustrates a partial configuration of the divider according to the embodiment.

As illustrated in FIG. 9, while the divider 200 is located at a predetermined position, the front portion 250*c* may be located between the first and second pinions 261 and 262 and interfere with the first and second pinions 261 and 262. In this case, the rotation of the first and second pinions 261 and 262 may be prevented. However, when the user operates the lever 215, and the second guide rack 227 may be moved backward, the first brake bar 250*a* may be moved backward, and thus the front portion 250*c* may also be moved backward, and an interference state with the first and second pinions 261 and 262 may be released. Therefore, when the user intends to move the divider 200 to a left side or a right side, the first and second pinions 261 and 262 may be moved along the first rack 118*a*.

A second brake bar 250*b* may be installed at one side of the second guide device 260*b*. A configuration of the second guide device 260*b* is substantially similar to the configuration of the first guide device 260*a*. The second brake bar 250*b* may be located between two pinions provided at the second guide device 260*b*, and may prevent rotation of the two pinions.

The second brake bar 250*b* may be coupled to a rear portion of the first link 221. When the user moves the lever 215 forward, and the first link 221 is moved forward, the second brake bar 250*b* may be moved forward, and thus the interference state of the second brake bar 250*b* with the two pinions may be released. Therefore, the first and second pinions provided at the second guide device 260*b* may be moved along the second rack 118*b*.

The power transmission device may further include a third link 228 which may be interlocked with the first link 221. The third link 228 may be provided to come into contact with a front of the first link 221, and also formed to be coupled to a front surface supporting part 240 of the divider 200. The front surface supporting part 240 may be in close contact with or sealed to an inner surface of the front surface cover 150, and may be provided to be movable. The front surface supporting part 240 may also be provided at both sides of a front of the divider body 210. A first side of the third link 228 may be in contact with the first link 221, and a second side thereof may be coupled to a lower portion of the front surface supporting part 240.

The third link 228 may have a bent shape. For example, the third link 228 may have a "¬" shape, and a second central shaft 229 which may serve as a rotating center of the third link 228 may be coupled to a bent portion.

The power transmission device may further include a third pin guide 232 which may guide movement of a third pin 228*a* provided at one side of the third link 228. The third pin 228*a* may be rotated about the second central shaft 229 inside the third pin guide 232. The third pin guide 232 may be formed in an arc shape having a curvature which is set corresponding to a rotating direction of the third link 228.

The first link 221 may include a contact surface 221*c* which may be in contact with the third link 228. The contact surface 221*c* may be in contact with one side of the third link 228. While the third link 228 is rotated, the first side of the third link 228 may be slid along the contact surface 221*c*. For example, the contact surface 221*c* may be formed to be rounded with a preset curvature.

The power transmission device may further include a third central shaft 240*a* which may be provided at one side of the front surface supporting part 240 and may serve as a rotating center of the front surface supporting part 240. The third central shaft 240*a* may be provided at an upper portion of the front surface supporting part 240.

When the user pulls forward the lever 215 by the predetermined distance, the first link 221 may be moved forward, and the contact surface 221*c* may press the third link 228 forward. The third link 228 may be rotated counterclockwise (in FIG. 8) about the second central shaft 229 by a pressing force. In this process, the third pin 228*a* may be moved inside the third pin guide 232.

According to rotation of the third link 228, the lower portion of the front surface supporting part 240 may be rotated counterclockwise about the third central shaft 240*a*. According to rotation of the front surface supporting part 240, a closely contacting (sealing) state between the front surface supporting part 240 and the front surface cover 150 may be released.

The power transmission device may further include a fourth link 241 which may be coupled to the first link 221. A plurality of fourth links 241 may be provided, and may be coupled to a front portion and a rear portion of the first link 221, respectively. The fourth link 241 may be arranged to extend downward from the first link 221, and may perform relative rotation with respect to the first link 221.

A lower surface supporting part 242 may be coupled to a lower side of the fourth link 241. The lower surface supporting part 242 may be in close contact with or sealed to the lower surface of the drawer body 110, and may be provided to be movable upward. The lower surface supporting part 242 may be provided at a lower end of the divider body 210.

When the first link 221 is moved forward, the fourth link 241 may be moved upward, and thus the lower surface supporting part 242 may be spaced apart from the lower surface of the drawer body 110, and the closely contacting state with the lower surface of the drawer body 110 may be released. Since the front surface supporting part 240 may be located at both sides of a front of the lower surface supporting part 242, and the rear surface supporting part 223 may be located at both sides of a rear of the lower surface supporting part 242, interference with the front surface supporting part 240 and the rear surface supporting part 223 may not occur even when the lower surface supporting part 242 is moved upward.

The power transmission device may include a plurality of springs 251, 252, 253, 254, 255 and 256 which return the above-described configurations to their original positions when an operation of the lever 215 is stopped. The plurality of springs 251, 252, 253, 254, 255 and 256 may include a first spring 251 coupled to a first spring coupling part (or first spring coupler) 251*a* of the divider body 210 to provide a restoring force to the first link 221. A first side of the first spring 251 may be coupled to the first spring coupling part 251*a*, and a second side of the first spring 251 may be coupled to the first link 221. For example, the first spring 251 may include a tension spring. When the lever 215 is moved forward, the first spring 251 may be tensioned, and when the operation of the lever 215 is stopped, the first link 221 may be returned to its original position by the first spring 251.

The plurality of springs 251, 252, 253, 254, 255 and 256 may include a second spring 252 coupled to a second spring coupling part (or second spring coupler) 252*a* of the divider body 210 to provide a restoring force to the second link 222. A first side of the second spring 252 may be coupled to the second spring coupling part 252*a*, and a second side of the second spring 252 may be coupled to the second link 222. For example, the second spring 252 may include a tension spring. When the second link 222 is moved forward, the second spring 252 may be tensioned, and when the operation of the lever 215 is stopped, the second link 222 may be returned to its original position by the second spring 252.

The plurality of springs 251, 252, 253, 254, 255 and 256 may include a third spring 253 coupled to a third spring coupling part (or third spring coupler) 253*a* of the divider body 210 to provide a restoring force to the first brake bar 250*a*. A first side of the third spring 253 may be coupled to the third spring coupling part 253*a*, and a second side of the third spring 253 may be coupled to the first brake bar 250*a*. For example, the third spring 253 may include a tension spring. When the first brake bar 250*a* is moved backward, the third spring 253 may be tensioned, and when the operation of the lever 215 is stopped, the first brake bar 250*a* may be returned to its original position, i.e., forward by the third spring 253.

The plurality of springs 251, 252, 253, 254, 255 and 256 may include a fourth spring 254 coupled to a fourth spring coupling part (or fourth spring coupler) 254*a* of the divider body 210 to provide a restoring force to the second brake bar 250*b*. A first side of the fourth spring 254 may be coupled to the fourth spring coupling part 254*a*, and a second side of the fourth spring 254 may be coupled to the second brake bar 250*b*. For example, the fourth spring 254 may include a tension spring. When the second brake bar 250*b* is moved forward, the fourth spring 254 may be tensioned, and when the operation of the lever 215 is stopped, the second brake bar 250*b* may be returned to its original position, i.e., forward by the fourth spring 254.

The plurality of springs 251, 252, 253, 254, 255 and 256 may include a fifth spring 255 coupled to a fifth spring coupling part (or fifth spring coupler) 255*a* of the divider body 210 to provide a restoring force to the third link 228. A first side of the fifth spring 255 may be coupled to the fifth spring coupling part 255*a*, and a second side of the fifth spring 255 may be coupled to the third link 228. For example, the fifth spring 255 may include a tension spring. When the third link 228 is rotated about the second central shaft 229, the fifth spring 255 may be tensioned, and when the operation of the lever 215 is stopped, the third link 228 may be returned to its original position by the fifth spring 255.

The plurality of springs 251, 252, 253, 254, 255 and 256 may include a sixth spring 256 coupled to a sixth spring coupling part (or sixth spring coupler) 256*a* of the divider body 210 to provide a restoring force to the first link 221. A first side of the sixth spring 256 may be coupled to the sixth spring coupling part 256*a*, and a second side of the sixth spring 256 may be coupled to the first link 221. For example, the sixth spring 256 may include a tension spring. When the first link 221 is moved forward, the sixth spring 256 may be tensioned, and when the operation of the lever 215 is stopped, the first link 221 may be returned to its original position by the sixth spring 256.

Figure 10:
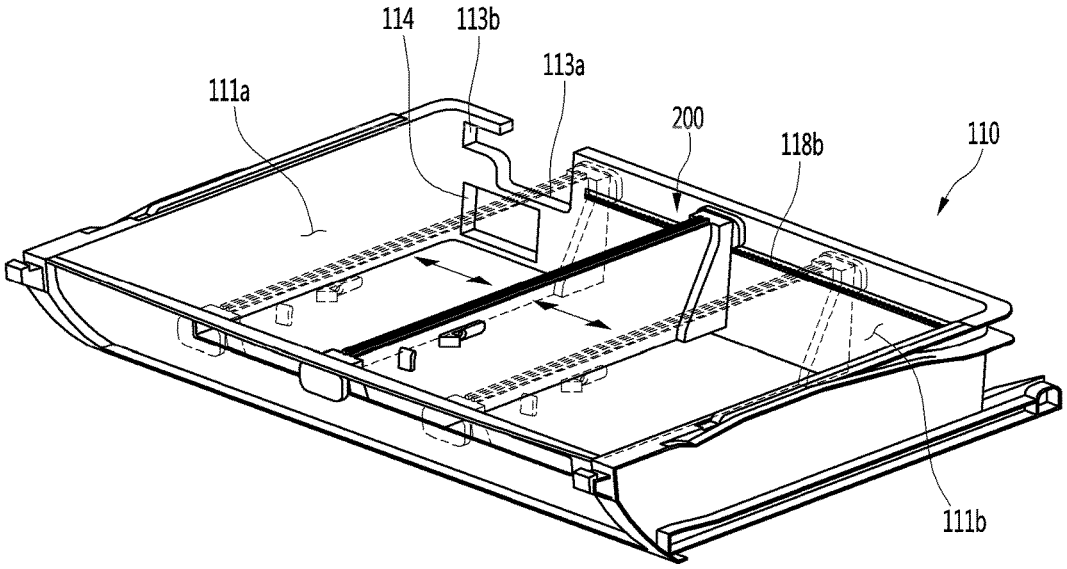
FIG. 10 illustrates a moving state of the divider according to the embodiment.

Referring to FIG. 10, when the user pulls the lever 215 forward, the front surface supporting part 240, the rear surface supporting part 223 and the lower surface supporting part 242 provided at the divider 200 may begin moving. According to movement of the front surface supporting part 240, the rear surface supporting part 223 and the lower surface supporting part 242, the closely contacting state with the front surface cover 150 and the drawer body 110 of the divider 200 may be released.

When the closely contacting state is released, the divider 200 may be in a movable state in a predetermined direction. At this point, when the user exerts a force left or right, the divider 200 may be moved, and during this process, the first guide device 260*a* and the second guide device 260*b* may be moved along the first rack 118*a* and the second rack 118*b*. The above-described first to fourth links 221, 222, 228 and 241 may be referred to as a "link assembly".

According to such a configuration and action, the storage space 111 of the drawer body 110 may be divided and sealed into independent spaces by the divider 200. Since the divider 200 may be moved by a simple operation, a size of each of the storage spaces may be easily varied.

Figure 11:
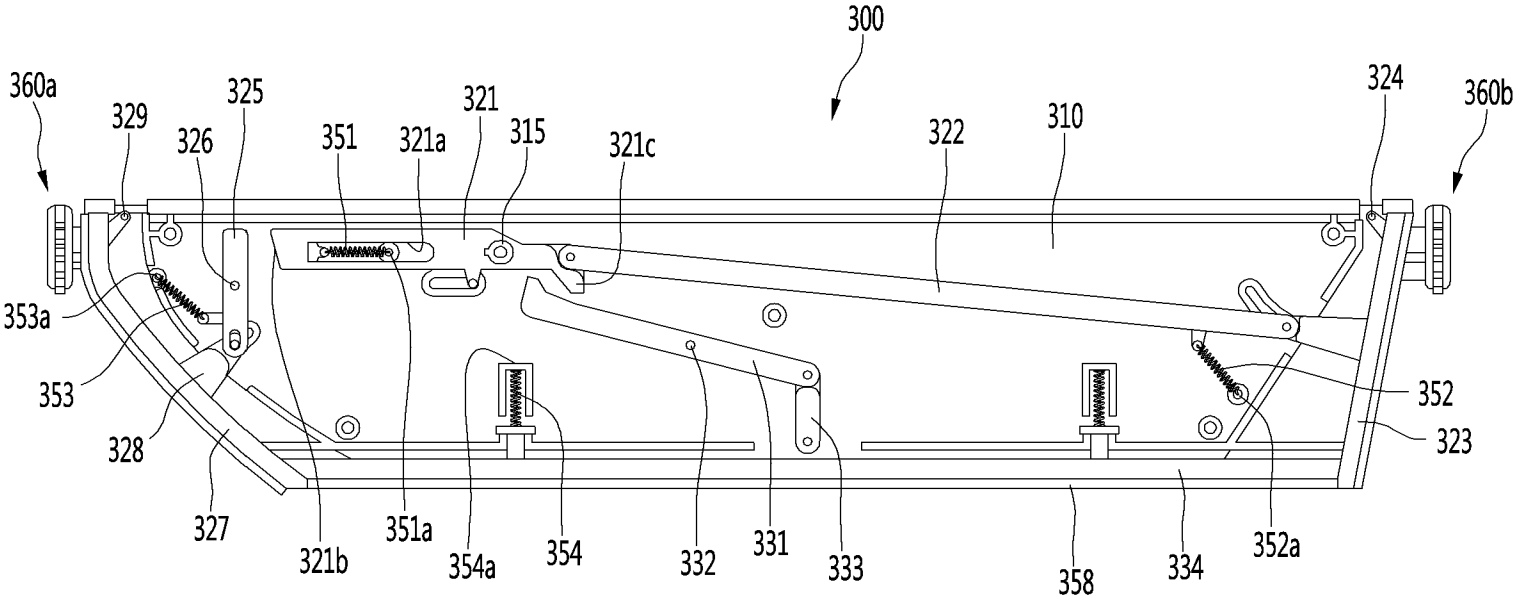
FIG. 11 illustrates an internal configuration of a divider according to another embodiment.

FIG. 11 illustrates an internal configuration of a divider according to another embodiment. The embodiment is different in only the configuration of the divider, and thus the difference will be mainly described, and the same components as those already described are designated by the same reference numerals. Referring to FIG. 11, a divider 300 according to another embodiment may include a divider body 310. The divider body 310 may include a lever 315 which may be operated by the user. The lever 315 is substantially similar to the first lever 215 in the first embodiment, and thus, a detailed description is omitted.

The divider 300 may further include movement guide devices 360*a* and 360*b* which may be installed at a front portion and a rear portion of the divider body 310 and interlocked with the first and second racks 118*a* and 118*b*, respectively. Specifically, the movement guide devices 360*a* and 360*b* may include a first guide device 360*a* which may be interlocked with the first rack 118*a*, and a second guide device 360*b* which may be interlocked with the second rack 118*b*. The first and second guide devices 360*a* and 360*b* are substantially similar to the first and second guide devices 260*a* and 260*b* in the first embodiment, and thus, a detailed description is omitted.

A power transmission device for moving the divider 300 may be provided inside the divider body 310. The power transmission device may include a first link 321 coupled to the lever 315, and a second link 322 coupled to the first link 321 and extending backward. The divider 300 may further include a rear surface supporting part 323 coupled to the second link 322. The rear surface supporting part 323 may be in close contact with the rear surface of the drawer body 110, and may be provided to be rotatable. A plurality of rear surface supporting parts 323 may be provided at both sides of a rear of the divider body 310. A first side of the second link 322 may be coupled to the first link 321, and a second side of the second link 322 may be coupled to the rear surface supporting part 323.

The divider 300 may further include a first central shaft 324 which may be provided at one side of the rear surface supporting part 323 and serve as a rotating center of the rear surface supporting part 323. The first central shaft 324 may be provided at an upper portion of the rear surface supporting part 323. The second link 322 may be coupled to an approximately center portion of the rear surface supporting part 323.

When the user pulls forward the lever 315 by a predetermined distance, the first link 321 may be moved forward, and the second link 322 may also be moved forward according to movement of the first link 321. According to movement of the second link 322, a force acting forward may be applied to the approximately center portion of the rear surface supporting part 323, and thus the rear surface supporting part 323 may be rotated about the first central shaft 324. For example, the rear surface supporting part 323 may be rotated clockwise in FIG. 11. In this process, a closely contacting (sealing) state of the rear surface supporting part 323 with the rear surface of the drawer body 110 may be released.

The power transmission device may further include a third link 325 which may be installed at a front of the first link 321, and a second central shaft 326 which may serve as a rotating center of the third link 325. The third link 325 may extend vertically. An upper portion of the third link 325 may be located at approximately the same height as that of the first link 321. A first pushing part 321*b* which may press the third link 325 may be formed at a front portion of the first link 321. The first link 321 may press the upper portion of the third link 325 when being moved forward. In this process, the third link 325 may be rotated counterclockwise (in FIG. 11) about the second central shaft 326.

The third link 325 may be formed to be coupled to a front surface supporting part 327 of the divider 300. The front surface supporting part 327 may be in close contact with the inner surface of the front surface cover 150, and may be provided to be rotatable. A plurality of front surface supporting parts 327 may be provided at both sides of a front of the divider body 310.

The divider 300 may further include a third central shaft 329 which may be provided at one side of the front surface supporting part 327 and serve as a rotating center of the front surface supporting part 327. The third central shaft 329 may be provided at an upper portion of the front surface supporting part 327. The third link 325 may be coupled to an approximately center portion of the front surface supporting part 327. Specifically, a link coupling part (or link coupler) 328 may protrude from the approximately center portion of the front surface supporting part 327. A lower portion of the third link 325 may be coupled to the link coupling part 328.

While the third link 325 is rotated, the lower portion of the third link 325 may be moved upward, and the link coupling part 328 and the front surface supporting part 327 may be rotated counterclockwise (in FIG. 11) about the third central shaft 329. In this process, the closely contacting state of the front surface supporting part 327 with the front surface cover 150 may be released.

The first link 321 may include a second pushing part 321*c*. The second pushing part 321*c* may protrude downward from the first link 321, and may be formed to press a fourth link 331. For example, the second pushing part 321*c* may be formed at a lower side of a coupling portion between the first link 321 and the second link 322.

The power transmission device may further include a lower surface supporting part 334 which may be in close contact with the lower surface of the drawer body 110, a fifth link 333 which may be coupled to the lower surface supporting part 334 and extend upward, and the fourth link 331 which may be coupled to an upper portion of the fifth link 333 and provided to be rotatable. The fourth link 331 may include a fourth central shaft 332 which serve as a rotating center of the fourth link 331. For example, the fourth central shaft 332 may be provided at an approximately center portion of the fourth link 331.

When the first link 321 is moved forward, the second pushing part 321*c* of the first link 321 may press a front portion of the fourth link 331. The fourth link 331 may be rotated counterclockwise (in FIG. 11) about the fourth central shaft 332. When the fourth link 331 is rotated, the fifth link 333 may be moved upward, and thus the lower surface supporting part 334 may also be moved upward.

The lower surface supporting part 334 may be in close contact with the lower surface of the drawer body 110, and may be provided to be movable upward. The lower surface supporting part 334 may be provided at a lower end of a center portion of the divider body 310. The lower surface supporting part 334 may be spaced apart from the lower surface of the drawer body 110 when being moved upward, and thus the closely contacting state with the lower surface of the drawer body 110 may be released. Since the front surface supporting part 327 may be located at both sides of a front of the lower surface supporting part 334, and the rear surface supporting part 323 may be located at both sides of a rear of the lower surface supporting part 334, interference with the front surface supporting part 327 and the rear surface supporting part 323 may not occur even when the lower surface supporting part 334 is moved upward.

The power transmission device may include a plurality of springs 351, 352, 353 and 354 which may return the above-described configurations to their original positions when an operation of the lever 315 is stopped. The plurality of springs 351, 352, 353 and 354 may include a first spring 351 which may be coupled to a first spring coupling part (or first spring coupler) 351*a* of the divider body 310 to provide a restoring force to the first link 321. One side of the first spring 351 may be coupled to the first spring coupling part 351*a*, and the other side of the first spring 351 may be coupled to an accommodation part 321*a* of the first link 321. The first spring 351 may be provided inside the accommodation part 321*a*. For example, the first spring 351 may include a tension spring. When the lever 315 is moved forward, the first spring 351 may be tensioned, and when the operation of the lever 315 is stopped, the first link 321 may be returned to its original position by the first spring 351.

The plurality of springs 351, 352, 353 and 354 may include a second spring 352 which may be coupled to a second spring coupling part (or second spring coupler) 352*a* of the divider body 310 to provide a restoring force to the second link 322. One side of the second spring 352 may be coupled to the second spring coupling part 352*a*, and the other side of the second spring 352 may be coupled to the second link 322. For example, the second spring 352 may include a tension spring. When the second link 322 may be moved forward, the second spring 352 may be tensioned, and when the operation of the lever 315 is stopped, the second link 322 may be returned to its original position by the second spring 352.

The plurality of springs 351, 352, 353 and 354 may include a third spring 353 which may be coupled to a third spring coupling part (or third spring coupler) 353*a* of the divider body 310 to provide a restoring force to the third link 325. One side of the third spring 353 may be coupled to the third spring coupling part 353*a*, and the other side of the third spring 353 may be coupled to the third link 325. For example, the third spring 353 may include a tension spring. When the third link 325 is rotated, the third spring 353 may be tensioned, and when the operation of the lever 315 is stopped, the third link 325 may be returned to its original position, i.e., forward by the third spring 353.

The plurality of springs 351, 352, 353 and 354 may include a fourth spring 354 which may be coupled to a fourth spring coupling part (or fourth spring coupler) 354*a* of the divider body 310 to provide a restoring force to the lower surface supporting part 334. A plurality of fourth springs 354 may be provided at a front portion and a rear portion of the divider 300, respectively. One side of the fourth spring 354 may be coupled to the fourth spring coupling part 354*a*, and the other side of the fourth spring 354 may be coupled to the lower surface supporting part 334. The fourth spring 354 may extend upward from the lower surface supporting part 334. For example, the fourth spring 354 may include a compression spring. When the lower surface supporting part 334 is moved upward, the fourth spring 354 may be compressed, and when the operation of the lever 315 is stopped, the lower surface supporting part 334 may be returned to its original position, i.e., downward by the fourth spring 354.

The divider 300 may further include a sealing member 358 which may be installed at an outer surface of each of the front surface supporting part 327, the rear surface supporting part 323 and the lower surface supporting part 334. The first and second space parts 111*a* and 111*b* may be easily divided and sealed by the sealing member 358. Although not described separately, the sealing member may also be installed at an outer surface of each of the plurality of supporting parts described in the earlier embodiment. The first to fourth links 321, 322, 325 and 331 may be collectively referred to as a "link assembly".

An operation of the divider 300 having the above-described configuration is substantially similar to that of FIG. 10. By the divider 300, the storage space 111 of the drawer body 110 may be divided and sealed into the independent spaces which may be controlled at different temperatures from each other. Since the divider 300 may be moved by a simple operation, a size of each of the storage spaces may be easily varied.

According to the proposed embodiments, since the divider is provided inside the drawer, and the storage space may be divided into a plurality of spaces by the divider, food may be stored separately according to types of food. Also, since the divider may be provided to be in close contact with the inner surface of the drawer body, and the plurality of spaces may be controlled at different temperatures from each other, the user can store the food at an optimal environment according to the types of the food. Since the divider is provided to be movable, the divided size of the plurality of spaces can be adjusted according to sizes of the food.

Since the lever may be provided at the divider so as to be easily operated by the user, and the front, rear and lower surfaces of the divider may be spaced apart from the inner surface of the drawer body according to the operation of the lever, the user's operation convenience may be improved. Also, when the user does not operate the lever, the pinion gear which may guide the movement of the divider may be fixed by the stopper, and thus the divider may be prevented from being moved or shaken while the drawer is inserted or withdrawn.

Even though all the elements of the embodiments are coupled into one or operated in the combined state, the present disclosure is not limited to such an embodiment. That is, all the elements may be selectively combined with each other without departing from the scope of the disclosure. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

A refrigerator may include a cabinet configured to form a storage compartment; and a drawer provided inside the storage compartment to be withdrawn, wherein the drawer includes a drawer body which forms a storage space; and a divider which is movably installed at the drawer body, and divides the storage space into a first space part to which cooling air is supplied and a second space part which is indirectly cooled by the cooling air, and the first space part and the second space part are controlled at different temperatures from each other.

The divider may include a plurality of supporting parts which divide and seal the first space part and the second space part, and the plurality of supporting parts may include a front surface supporting part which is in close contact with a front surface of the drawer, a rear surface supporting part which is in close contact with a rear surface of the drawer, and a lower surface supporting part which is in close contact with a lower surface of the drawer. The drawer may include a guide device which guides movement of the divider. The guide device may include a first rack which is provided at the front surface of the drawer, a second rack which is provided at the rear surface of the drawer, and a pinion which is interlocked with the first rack or the second rack.

The divider may include a lever which is operated by a user, and a link assembly which enables the plurality of supporting parts to be spaced apart from the drawer by an operation of the lever. The link assembly may include a first link which is coupled to the lever, and a second link which is coupled to the first link and enables the rear surface supporting part to be spaced apart from the rear surface of the drawer according to movement of the first link. The link assembly may include a third link which is provided to be pressed by the first link and thus to be rotatable, and enables the front surface supporting part to be spaced apart from the front surface of the drawer according to movement of the first link. The link assembly may include a fourth link which is coupled to the first link and the lower surface supporting part, and enables the lower surface supporting part to be spaced apart from the lower surface of the drawer according to movement of the first link.

The divider may include a first guide rack which is coupled to the first link, a guide pinion which is interlocked with the first guide rack, and a second guide rack which is interlocked with the guide pinion. The refrigerator may further include a brake bar which is coupled to the second guide rack and restricts rotation of the pinion, and the brake bar may include a front portion located between two pinions. The refrigerator may further include a plurality of springs which are coupled to the link assembly, and the plurality of springs may include a tension spring which returns the link assembly when the operation of the lever is stopped. The link assembly may include a fourth link which is provided to be pressed by the first link and thus to be rotatable, and enables the lower surface supporting part to be spaced apart from the lower surface of the drawer according to movement of the first link.

The refrigerator may further include a plurality of springs which are coupled to the link assembly, and the plurality of springs may include a compression spring which returns the link assembly when the operation of the lever is stopped. The refrigerator may further include a sealing member which is installed at an outer surface of each of the plurality of supporting parts of the divider, and seals the first and second space parts. The storage compartment may include a refrigerator compartment and a freezer compartment which are divided by a partition part, and the drawer may be installed inside the refrigerator compartment.

A refrigerator may include a cabinet configured to form a storage compartment; and a drawer provided inside the storage compartment to be withdrawn, wherein the drawer includes a drawer body which forms a storage space; a fan which is installed at one side of the drawer body; a cooling air duct which is provided at an upper side of the drawer body, and guides a flow of cooling air generated by the fan; and a divider which divides the storage space into a plurality of space parts and is provided to be movable.

The refrigerator may further include a multi-duct which forms a rear wall of the storage compartment and has a cooling air outlet hole; and a fan housing which is provided at a lower side of the multi-duct to accommodate the fan, and has an outlet port through which the cooling air is discharged, and the cooling air duct may include a cover which covers the outlet port. The divider may include a lever which is operated by a user.

The divider may include a divider body, and a plurality of supporting parts which are provided at front, rear and lower sides of the divider body and provided to be movable by an operation of the lever. The drawer may include a guide device which guides movement of the divider, and the guide device may include a rack which is provided at an inner surface of the drawer body, and a pinion which is provided at the divider and interlocked with the rack.

A direction that the freezer door 22 or the drawer 100 is withdrawn may be defined as a front, and an opposite direction may be defined as a rear. A direction that the two refrigerator doors 21 are arranged in parallel may be defined as a lateral direction.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that forms a storage compartment; and a drawer provided inside the storage compartment and configured to be withdrawn, wherein the drawer includes:

a drawer body forming a storage space;

a divider movably installed at the drawer body that divides the storage space into a first space to which cooling air is supplied and a second space which is indirectly cooled by the cooling air, wherein the first space and the second space are controlled at different temperatures from each other;

a lever provided at the divider;

a first rack provided at a front surface of the drawer;

a second rack provided at a rear surface of the drawer;

a pinion that is provided at the divider and is interlocked with the first rack or the second rack, the pinion including first and second pinions; and a brake bar configured to move by operation of the lever, wherein the brake bar includes a front portion configured to be inserted between the first and second pinions to prevent rotation of the first and second pinions.

2. The refrigerator according to claim 1, wherein the divider includes a plurality of supports which divide and seal the first space and the second space, wherein the plurality of supports includes:

a front surface support which contacts a front surface of the drawer;

a rear surface support which contacts a rear surface of the drawer; and a lower surface support which contacts a lower surface of the drawer.

3. The refrigerator according to claim 1, wherein the divider further includes:

a lever; and a link assembly which enables the plurality of supports to be spaced apart from the drawer by an operation of the lever.

4. The refrigerator according to claim 3, wherein the link assembly includes:

a first link coupled to the lever; and a second link coupled to the first link that enables the rear surface support to be spaced apart from the rear surface of the drawer according to movement of the first link.

5. The refrigerator according to claim 4, wherein the link assembly includes:

a third link provided to be pressed by the first link and to be rotatable, wherein the third link enables the front surface support to be spaced apart from the front surface of the drawer according to movement of the first link.

6. The refrigerator according to claim 4, wherein the link assembly includes a fourth link provided to be pressed by the first link and to be rotatable, wherein the fourth link enables the lower surface support to be spaced apart from the lower surface of the drawer according to movement of the first link.

7. The refrigerator according to claim 4, wherein the divider includes:

a first guide rack coupled to the first link;

a guide pinion interlocked with the first guide rack; and a second guide rack interlocked with the guide pinion.

8. The refrigerator according to claim 7, wherein the brake bar is coupled to the second guide rack.

9. The refrigerator according to claim 3, further including a plurality of springs coupled to the link assembly, wherein the plurality of springs includes a tension spring which returns the link assembly to an original position when the operation of the lever is stopped.

10. The refrigerator according to claim 3, further including a plurality of springs coupled to the link assembly, wherein the plurality of springs includes a compression spring which returns the link assembly to the original position when the operation of the lever is stopped.

11. The refrigerator according to claim 1, further including a sealing member installed at an outer surface of each of the plurality of supports of the divider, and seals the first and second spaces.

12. The refrigerator according to claim 1, wherein the storage compartment includes a refrigerator compartment and a freezer compartment which are divided by a partition part, and the drawer is installed inside the refrigerator compartment.

13. A refrigerator comprising:

a cabinet that forms a storage compartment; and a drawer provided inside the storage compartment to be withdrawn, wherein the drawer includes:

a drawer body that forms a storage space;

a divider that divides the storage space into a plurality of spaces and is provided to be movable, the divider including:

a divider body;

an operable lever that protrudes from a surface of the divider body, the lever being configured to move;

a plurality of supports provided at the divider body and configured to be movable upon movement of the lever, the plurality of supports including:

a front surface support which contacts a front surface of the drawer;

a rear surface support which contacts a rear surface of the drawer; and a lower surface support which contacts a lower surface of the drawer, a power transmission device that is coupled to the lever and operably connected to the front, the rear, and the lower surface supports, wherein the front, the rear, and the lower surface supports are spaced apart from the front, the rear, and the lower surfaces of the drawer, respectively, when the lever moves to allow the divider to move, wherein the power transmission device comprises:

a link assembly provided in the divider body which enables the plurality of supports to be spaced apart from the drawer when the lever is pulled; and at least one spring coupled to the link assembly, the at least one spring being configured to return the link assembly to an original position when the lever is released.

14. The refrigerator according to claim 13, further including:

a multi-duct that forms a rear wall of the storage compartment and has a cooling air outlet hole; and a fan housing provided at a lower side of the multi-duct to accommodate the fan that has an outlet port through which the cooling air is discharged, wherein the cooling air duct includes a cover which covers the outlet port.

15. The refrigerator according to claim 13, wherein the drawer includes a guide device which guides movement of the divider, the guide device including:

a rack provided at an inner surface of the drawer body; and a pinion provided at the divider and interlocked with the rack.

16. A refrigerator comprising:

a cabinet that forms a storage compartment; and a drawer provided inside the storage compartment and configured to be withdrawn, wherein the drawer includes:

a drawer body forming a storage space; and a divider movably installed at the drawer body that divides the storage space into a first space and a second space, wherein the movable divider includes:

a plate;

a front support wall provided on a front end of the plate;

a rear support wall provided on a rear end of the plate;

a lever, wherein movement of the lever moves the front and the rear support walls to break a contact of the front and rear support walls from a front and rear surface of the drawer, respectively; and a link assembly which enables the front and the rear support walls to be spaced apart from the drawer by an operation of the lever, wherein the link assembly includes:

a first link coupled to the lever;

a second link coupled to the first link that enables the rear support wall to be spaced apart from the rear surface of the drawer according to movement of the first link; and a third link configured to be pressed and rotated by the first link, wherein the third link enables the front surface support to be spaced apart from the front surface of the drawer according to a movement of the first link.

* * * * *